US009470098B2

(12) United States Patent
Latimer et al.

(10) Patent No.: US 9,470,098 B2
(45) Date of Patent: Oct. 18, 2016

(54) AXIAL COMPRESSOR AND METHOD FOR CONTROLLING STAGE-TO-STAGE LEAKAGE THEREIN

(71) Applicant: General Electric Company, Schenectady, NY (US)

(72) Inventors: Jeremy Peter Latimer, Greenville, SC (US); Eric Richard Bonini, Greenville, SC (US); John Duong, Greenville, SC (US)

(73) Assignee: General Electric Company, Schenectady, NY (US)

( * ) Notice: Subject to any disclaimer, the term of this patent is extended or adjusted under 35 U.S.C. 154(b) by 754 days.

(21) Appl. No.: 13/834,745

(22) Filed: Mar. 15, 2013

(65) Prior Publication Data

US 2014/0271109 A1 Sep. 18, 2014

(51) Int. Cl.
*F01D 11/00* (2006.01)
*F01D 5/30* (2006.01)
*F01D 5/08* (2006.01)

(52) U.S. Cl.
CPC ..... *F01D 5/3007* (2013.01); *F01D 5/085* (2013.01)

(58) Field of Classification Search
CPC ..... F01D 11/008; F01D 5/08; F01D 5/30; F01D 5/22
See application file for complete search history.

(56) References Cited

U.S. PATENT DOCUMENTS 2,751,189 A * 6/1956 Ledwith ..... F01D 5/3007 416/193 A
3,748,060 A 7/1973 Hugoson et al.
3,936,227 A * 2/1976 Wojcik ..... F01D 5/081 416/95
4,326,835 A * 4/1982 Wertz ..... F01D 5/22 416/193 A
4,444,544 A * 4/1984 Rowley ..... F01D 5/326 416/218
5,139,389 A * 8/1992 Eng ..... F01D 5/3007 416/219 R (Continued)

FOREIGN PATENT DOCUMENTS

DE 19705323 A1 * 8/1998 ..... F01D 5/3007

*Primary Examiner* — Thai Ba Trieu
*Assistant Examiner* — Shafiq Mian
(74) *Attorney, Agent, or Firm* — Sutherland Asbill & Brennan LLP

(57) ABSTRACT

The present application and the resultant patent provide an axial compressor for a gas turbine engine. The compressor may include a rotor disk positioned along an axis of the compressor. The rotor disk may include a slot defined about a radially outer surface of the rotor disk, and the slot may include a slot planar surface facing away from the rotor disk. The compressor also may include a compressor blade coupled to the rotor disk via the slot. The compressor blade may include a platform positioned over the radially outer surface of the rotor disk, and the platform may include a platform sealing edge facing toward the rotor disk. The compressor further may include a gap defined between the platform sealing edge and the slot planar surface, wherein the gap is configured to control a flow of leakage air from a high-pressure side of the compressor blade to a low-pressure side of the compressor blade. The present application and the resultant patent further provide a related method of controlling stage-to-stage leakage in an axial compressor of a gas turbine engine.

17 Claims, 4 Drawing Sheets

(56) References Cited

U.S. PATENT DOCUMENTS 5,228,835 A 7/1993 Chlus
6,375,429 B1 * 4/2002 Halila ..... F01D 5/26 416/193 A
6,398,449 B1 * 6/2002 Loh ..... E06B 3/667 403/280
6,419,452 B1 * 7/2002 Frosini ..... F01D 5/323 416/193 A
6,575,704 B1 * 6/2003 Tiemann ..... F01D 11/006 416/219 R
6,579,065 B2 * 6/2003 Scott ..... F01D 11/006 416/193 A
7,997,861 B2 * 8/2011 Hudson ..... F01D 5/141 415/189
9,097,131 B2 * 8/2015 Boyington
2002/0044870 A1 * 4/2002 Simonetti ..... F01D 5/28 416/221
2010/0092298 A1 * 4/2010 Hudson ..... F01D 5/141 416/223 R
2010/0166561 A1 * 7/2010 Boyer ..... F01D 5/3007 416/219 R
2010/0247317 A1 * 9/2010 Piersall ..... F01D 5/3007 416/219 R

* cited by examiner

AXIAL COMPRESSOR AND METHOD FOR CONTROLLING STAGE-TO-STAGE LEAKAGE THEREIN

TECHNICAL FIELD

The present application and the resultant patent relate generally to gas turbine engines and more particularly relate to an axial compressor for a gas turbine engine and a method for controlling stage-to-stage leakage therein.

BACKGROUND OF THE INVENTION

As is known, an axial compressor for a gas turbine engine may include a number of stages arranged along an axis of the compressor. Each stage may include a rotor disk and a number of replaceable compressor blades arranged about a circumference of the rotor disk. To facilitate replacement, the blades may be removably attached to the rotor disk via dovetail connections by which root portions of the blades are inserted axially into respective slots formed about the circumference of the rotor disk. According to a full-pitch platform configuration, each blade may include a platform portion extending circumferentially and abutting the platform portions of adjacent blades. In this manner, the platform portions may define a radially inner boundary of a compressed air flowpath. Additionally, the platform portions may define a radially outer boundary of a cavity formed between the platform portions and an outer surface of the rotor disk. During operation of the compressor, a portion of the compressed air may pass upstream through the cavity from a high-pressure side of the compressor blades to a low-pressure side of the compressor blades. Such stage-to-stage leakage of compressed air may reduce efficiency and surge margin of the compressor itself as well as the overall gas turbine engine.

Certain axial compressors including compressor blades having a full-pitch platform configuration may include a cover plate positioned over the cavity on at least one of the upstream side or the downstream side of the blades. In this manner, the cover plate may reduce stage-to-stage leakage of compressed air, although the cover plate and associated hardware may increase the complexity, size, and weight of the compressor stage at the disk-blade interface. Other axial compressors may reduce stage-to-stage leakage by including a sealant, such as a room temperature vulcanizing (RTV) sealant, which fills at least a portion of the cavity to block air flow therethrough. However, such a sealant may be difficult to design and validate for long-term leakage control in an axial compressor because it may degrade over time and thus may allow for varying levels of leakage over the life of the compressor.

There is thus a desire for an improved axial compressor for a gas turbine engine and a method for controlling stage-to-stage leakage therein. Specifically, such a compressor may control leakage of compressed air through a cavity formed between a rotor disk and platform portions of compressor blades having a full-pitch platform configuration. Such leakage control may increase efficiency and surge margin of the compressor and the overall gas turbine engine. Preferably, such a compressor will not require additional components at the disk-blade interface or a sealant that may degrade over time.

SUMMARY OF THE INVENTION

The present application and the resultant patent thus provide an axial compressor for a gas turbine engine. The compressor may include a rotor disk positioned along an axis of the compressor. The rotor disk may include a slot defined about a radially outer surface of the rotor disk, and the slot may include a slot planar surface facing away from the rotor disk. The compressor also may include a compressor blade coupled to the rotor disk via the slot. The compressor blade may include a platform positioned over the radially outer surface of the rotor disk, and the platform may include a platform sealing edge facing toward the rotor disk. The compressor further may include a gap defined between the platform sealing edge and the slot planar surface, wherein the gap is configured to control a flow of leakage air from a high-pressure side of the compressor blade to a low-pressure side of the compressor blade.

The present application and the resultant patent further provide a method of controlling stage-to-stage leakage in an axial compressor of a gas turbine engine. The method may include the step of passing a flow of compressed air over a compressor blade from a low-pressure side of the compressor blade to a high-pressure side of the compressor blade. The method also may include the step of passing a flow of leakage air between a platform of the compressor blade and a rotor disk from the high-pressure side of the compressor blade to a low-pressure side of the compressor blade. The method further may include the step of controlling the flow of leakage air with a gap defined between a platform sealing edge and a slot planar surface defined about a radially outer surface of the rotor disk.

The present application and the resultant patent further provide an axial compressor for a gas turbine engine. The compressor may include a rotor disk positioned along an axis of the compressor. The rotor disk may include a slot defined about a radially outer surface of the rotor disk, and the slot may include a first slot planar surface and a second slot planar surface each facing away from the rotor disk. The compressor also may include a compressor blade coupled to the rotor disk via the slot. The compressor blade may include a platform positioned over the radially outer surface of the rotor disk, and the platform may include a first platform sealing edge and a second platform sealing edge facing toward the rotor disk. The compressor further may include a first gap defined between the first platform sealing edge and the first slot planar surface, and a second gap defined between the second platform sealing edge and the second slot planar surface, wherein the first gap and the second gap each are configured to control a flow of leakage air from a high-pressure side of the compressor blade to a low-pressure side of the compressor blade.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
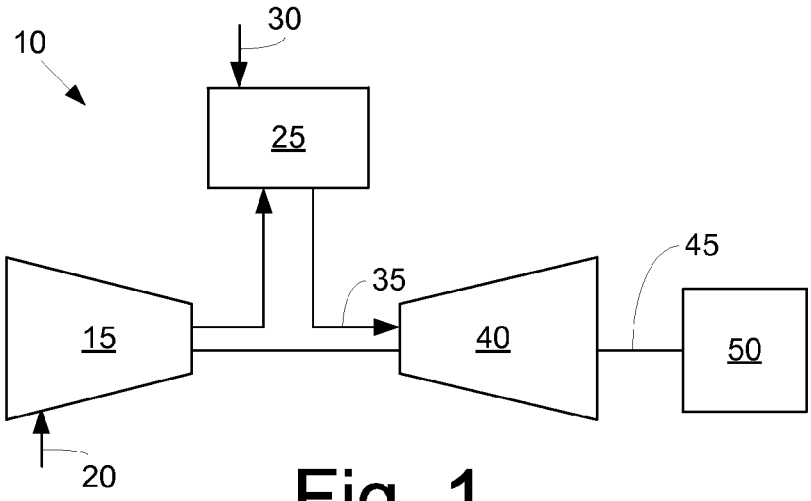
FIG. 1 is a schematic diagram of a gas turbine engine including a compressor, a combustor, and a turbine.

Referring now to the drawings, in which like numerals refer to like elements throughout the several views, FIG. 1 shows a schematic view of a gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like. Other configurations and other components may be used herein.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together. Although the gas turbine engine 10 is shown herein, the present application may be applicable to any type of turbo machinery.

Figure 2:
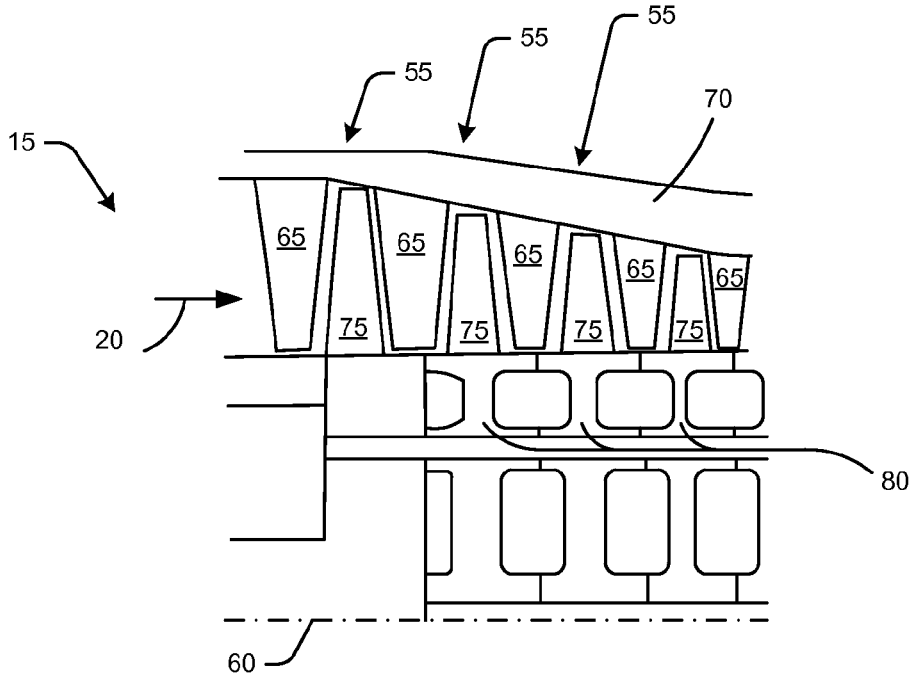
FIG. 2 is a schematic diagram of a portion of an axial compressor as may be used in the gas turbine engine of FIG. 1, showing a number of compressor stages.

FIG. 2 shows a schematic view of a portion of the compressor 15 including a number of stages 55 arranged along an axis 60 of the compressor 15. Each stage 55 may include a number of circumferentially-spaced stator vanes 65 coupled to a static compressor casing 70. Each stage 55 also may include a number of circumferentially-spaced compressor blades 75 coupled to a rotor disk 80. During operation, the rotor disk 80 and the compressor blades 75 rotate about the axis 60 of the compressor 15 while the stator vanes 65 remain stationary. In this manner, the compressor blades 75 cooperate with the adjacent stator vanes 65 to impart kinetic energy to and compress the incoming flow of air 20, which is then delivered to the combustor 25. Other types of compressor configurations may be used.

FIGS. 3-8 show various views of a portion of an axial compressor 100 as may be described herein. The compressor 100 may include a number of stages arranged along an axis of the compressor 100. Each stage may include a number of circumferentially-spaced compressor blades 104 coupled to a rotor disk 108, although only one compressor blade 104 is shown for simplicity of illustration. In this manner, the rotor disk 108 may be positioned along the axis of the compressor 100, and each compressor blade 104 may extend radially from the rotor disk 108.

Figure 3:
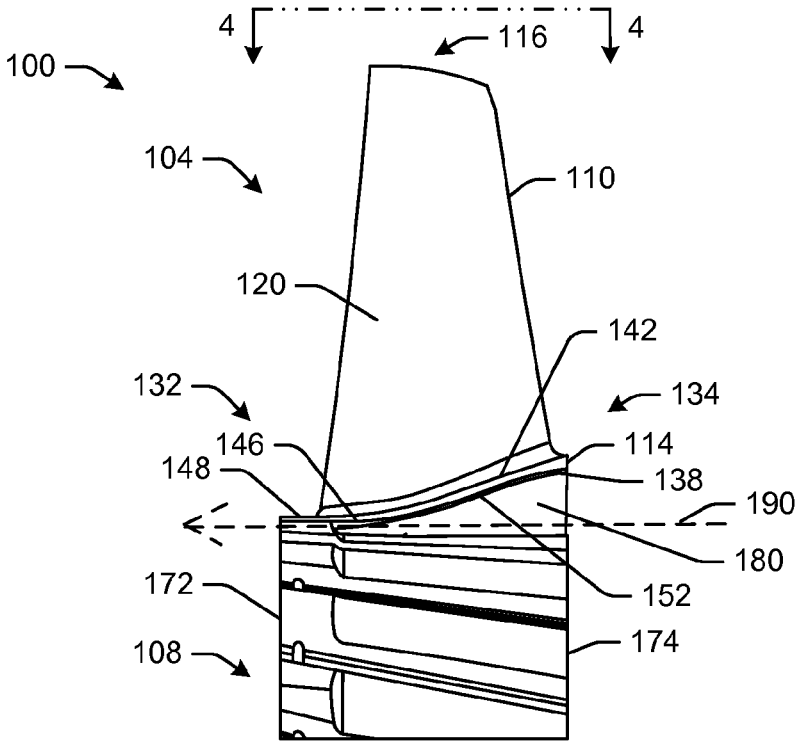
FIG. 3 is a front plan view of a portion of an axial compressor as may be described herein, showing a compressor blade and a portion of a rotor disk of one stage of the axial compressor.
Figure 4:
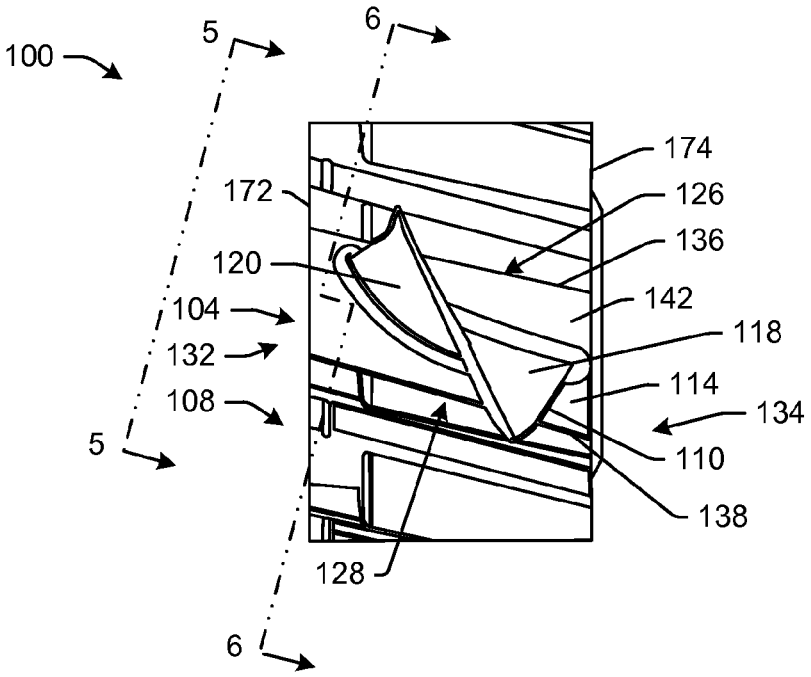
FIG. 4 is a top view of the portion of the axial compressor of FIG. 3, taken along line 4-4.

As is shown in FIGS. 3 and 4, the compressor blade 104 may include an airfoil 110, a root 112, and a platform 114 positioned between the airfoil 110 and the root 112. The airfoil 110 may extend radially outward from the platform 114 to a tip end 116 of the compressor blade 104. The airfoil 110 may have a complex three-dimensional shape that may extend circumferentially from a generally concave surface 118 to a generally convex surface 120. The three-dimensional shape of the airfoil 110 may be selected to optimize aerodynamic performance of the respective compressor stage. The root 112 may extend radially inward from the platform 114 to a root end 122 of the compressor blade 104, such that the platform 114 generally defines an interface between the airfoil 110 and the root 112. The root 112 may be formed to define a dovetail or similar structure configured to couple the compressor blade 104 to the rotor disk 108. Overall, the compressor blade 104 may have a concave side 126 corresponding to the concave surface 118 of the airfoil 110, and a convex side 128 corresponding to the convex surface 120 of the airfoil 110. Further, the compressor blade 104 may have an upstream end 132 and a downstream end 134 corresponding to the direction of the flow of air 20 through the compressor 100.

The platform 114 may extend circumferentially from a first lateral surface 136 to a second lateral surface 138. As is shown, the first lateral surface 136 may be formed along the concave side 126 of the compressor blade 104, and the second lateral surface 138 may be formed along the convex side 128 of the compressor blade 104. In certain aspects, the platform 114 may have a full-pitch configuration, and thus the first lateral surface 136 of the platform 114 of each compressor blade 104 may abut the second lateral surface 138 of the platform 114 of an adjacent compressor blade 104. The platform 114 may extend axially from the upstream end 132 to the downstream end 134 of the compressor blade 104.

Figure 6:
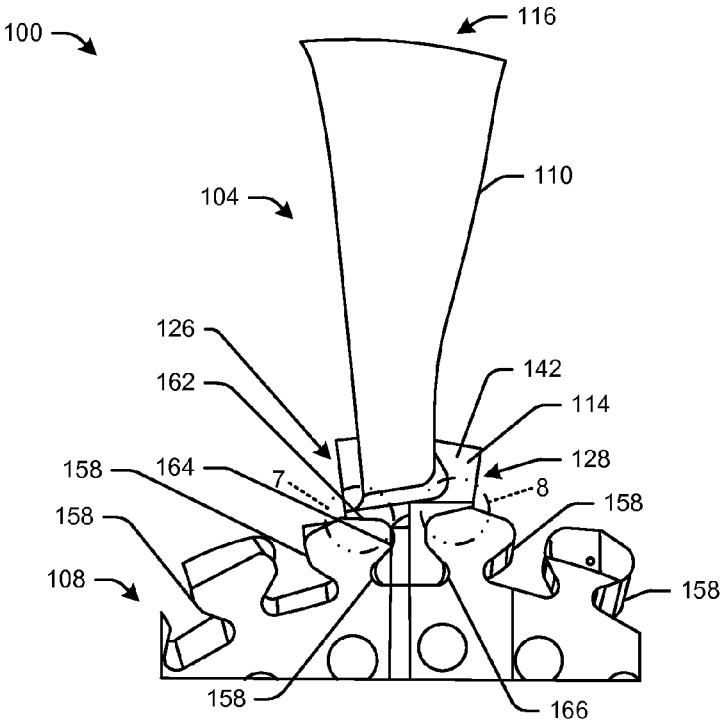
FIG. 6 is a section view of the portion of the axial compressor of FIG. 4, taken along line 6-6.

Further, the platform 114 may have a radially outer side 142 and a radially inner side 144. As is shown, the radially outer side 142 faces away from the root 112 and toward the airfoil 110, and the radially inner side 144 faces away from the airfoil 110 and toward the root 112. The platform 114 may have a complex three-dimensional shape including various surfaces selected to optimize aerodynamic performance of the respective compressor stage. In certain aspects, the radially inner side 144 of the platform may include at least one sealing edge 146. The at least one sealing edge 146 may be positioned near the upstream end 132 of the compressor blade 104. Specifically, the at least one sealing edge 146 may extend from one of the first lateral surface 136 and the second lateral surface 138 to the root 112. As is shown in FIGS. 4 and 6, the at least one sealing edge 146 may extend along line 6-6. In certain aspects, the radially inner side 144 of the platform 114 also may include at least one planar surface 148. The at least one planar surface 148 may be positioned near the upstream end 132 of the compressor blade 104. Specifically, the at least one planar surface 148 may extend from the upstream end 132 to the at least one sealing edge 146 of the compressor blade 104. In some aspects, the radially inner side 144 of the platform 114 also may include a curved surface 152 extending from the sealing edge 146 toward the downstream end 134 of the compressor blade 104. In some aspects, the contour of the radially outer side 142 may match and be offset from the contour of the radially inner side 144. In this manner, the platform 114 may have a constant radial thickness between the radially outer side 142 and the radially inner side 144.

In certain aspects, as is shown, the radially inner side 144 of the platform 114 may include two sealing edges 146. One of the sealing edges 146 may be positioned on the concave side 126 of the compressor blade 104, and the other of the sealing edges 146 may be positioned on the convex side 128 of the compressor blade 104. In this manner, the sealing edges 146 may be circumferentially separated by the root 112 of the compressor blade. In some aspects, the sealing edges 146 each may be positioned near the upstream end 132 of the compressor blade 104. Specifically, the sealing edges 146 each may extend from one of the first lateral surface 136 and the second lateral surface 138 to the root 112. As is shown in FIGS. 4 and 6, the sealing edges 146 each may extend along line 6-6. In certain aspects, as is shown, the radially inner side 144 of the platform 114 may include two planar surfaces 148. One of the planar surfaces 148 may be positioned on the concave side 126 of the compressor blade 104, and the other of the planar surfaces 148 may be positioned on the convex side 128 of the compressor blade 104. In this manner, the planar surfaces 148 may be circumferentially separated by the root 112 of the compressor blade. In some aspects, the planar surfaces 148 each may be positioned near the upstream end 132 of the compressor blade 104. Specifically, the planar surfaces 148 each may extend from the upstream end 132 toward the downstream end 134 of the compressor blade 104 to one of the sealing edges 146. In certain aspects, the radially inner side 144 of the platform 114 also may include a curved surface 152 extending from each of the sealing edges 146 toward the downstream end 134 of the compressor blade 104. In some aspects, the contour of the radially outer side 142 may match and be offset from the contour of the radially inner side 144. In this manner, the platform 114 may have a constant radial thickness between the radially outer side 142 and the radially inner side 144.

Figure 5:
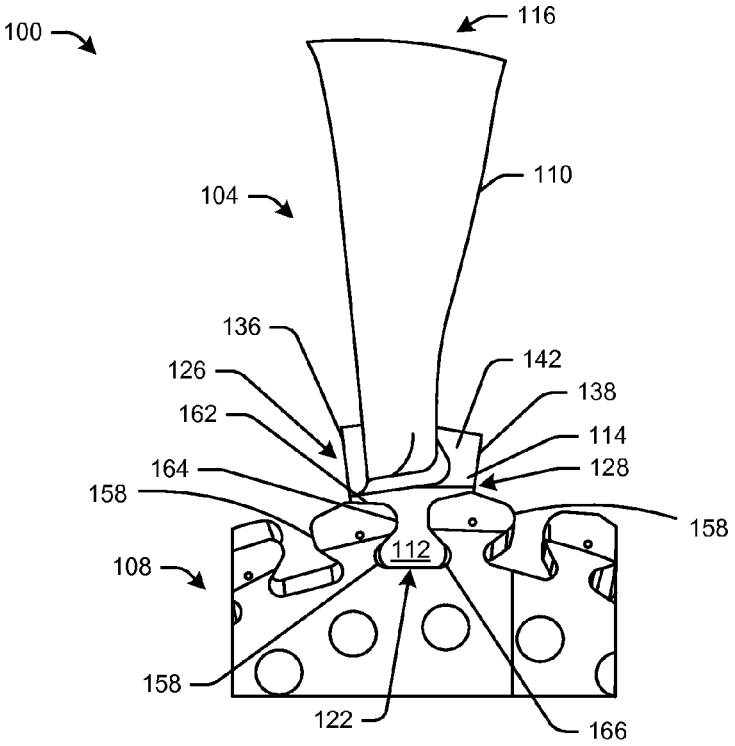
FIG. 5 is a plan view of the portion of the axial compressor of FIG. 4, taken along line 5-5.

As is shown in FIGS. 5 and 6, the rotor disk 108 may include a number of slots 158 defined about the outer circumference of the rotor disk 108 for coupling the compressor blades 104 to the rotor disk 108. Specifically, each slot 158 may be configured to receive the root 112 of one compressor blade 104, which may be inserted axially or obliquely into the slot 158. For example, the root 112 may be formed to define a dovetail, and the slot 158 may be formed to define a mating dovetail slot. The slot 158 may include a mouth 162, a neck 164, and a base 166, all of which extend axially or obliquely from an upstream end 172 of the rotor disk 108 to a downstream end 174 of the rotor disk 108. The mouth 162 of the slot 158 may be defined about the outer circumference of the rotor disk 108. In some aspects, the mouth 162 may taper radially inward, as is shown. The neck 164 may be defined radially inward from the mouth 162, and the neck 164 may have a smaller circumferential width than the mouth 162. The base 166 may be defined radially inward from the neck 164, and the base 166 may have a greater circumferential width than the neck 164.

The slot 158 of the rotor disk 108 may include at least one planar surface 178 facing away from the rotor disk 108 and toward the compressor blade 104. In some aspects, the at least one planar surface 178 may be formed on the mouth 162 of the slot 158. The at least one planar surface 178 may be positioned near the upstream end 172 of the rotor disk 108. Specifically, the at least one planar surface 178 may extend from the upstream end 172 toward the downstream end 174 of the rotor disk 108.

In certain aspects, the slot 158 of the rotor disk 108 may include two planar surfaces 178 facing away from the rotor disk 108 and toward the compressor blade 104. Specifically, the planar surfaces 178 may be formed on the mouth 162 of the slot 158. One of the planar surfaces 178 may be formed on the mouth 162 on one circumferential side of the neck 164, and the other of the planar surfaces 178 may be formed on the mouth 162 on the other circumferential side of the neck 164. In this manner, the planar surfaces 178 may be circumferentially separated by the neck 164 of the slot 158. In some aspects, the planar surfaces 178 each may be positioned near the upstream end 172 of the rotor disk 108. Specifically, the planar surfaces 178 each may extend from the upstream end 172 toward the downstream end 174 of the rotor disk 108.

As is shown, the root 112 of the compressor blade 104 may be received within the slot 158 of the rotor disk 108, thereby coupling the compressor blade 104 to the rotor disk 108. Due to the full-pitch configuration of the platform 114, a cavity 180 may be defined between the radially inner side 144 of the platform 114 and the mouth 162 of the slot 158. The radial height of the cavity 180 may vary along the axial and circumferential directions depending on the contour of the radially inner side 144 of the platform 114 and the contour of the mouth 162.

Figure 7:
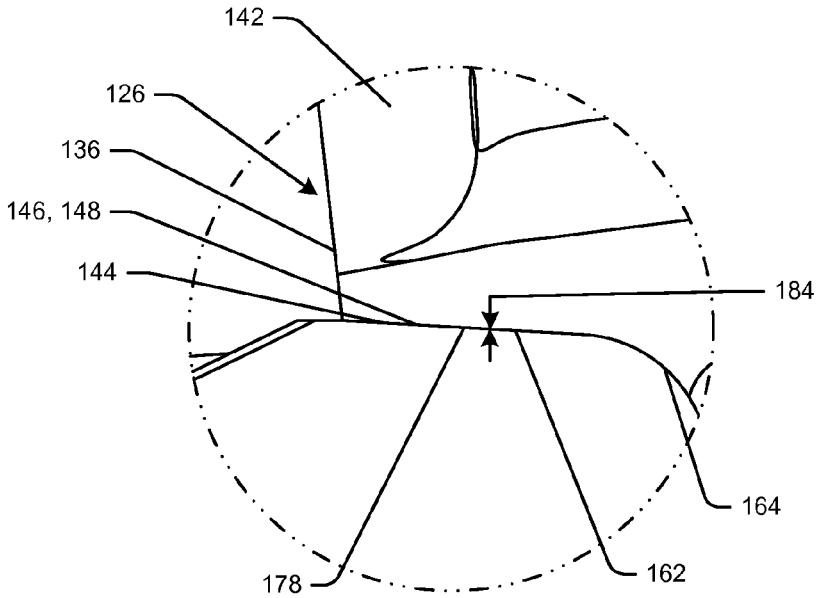
FIG. 7 is a detail view of the portion of the axial compressor of FIG. 6, as indicated.
Figure 8:
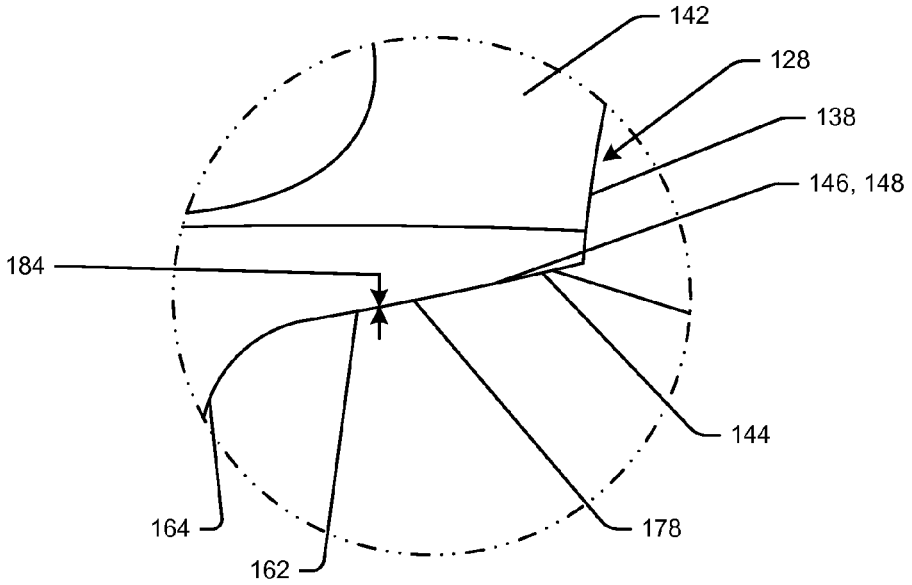
FIG. 8 is a detail view of the portion of the axial compressor of FIG. 6, as indicated.

As is shown in FIGS. 7 and 8, each sealing edge 146 of the platform 114 may face one of the planar surfaces 178 of the slot 158. In certain aspects, the sealing edge 146 of the platform 114 may be parallel to and offset from the planar surface 178 of the slot 158. In this manner, the cavity 180 may include a small, constant gap 184 defined between the sealing edge 146 of the platform 114 and the planar surface 178 of the slot 158. Specifically, the gap 184 may be defined between the sealing edge 146 of the platform 114 and the planar surface 178 of the slot 158 near the upstream end 132 of the compressor blade 104 and the upstream end 172 of the rotor disk 108.

As is also shown in FIGS. 7 and 8, each planar surface 148 of the platform 114 may face one of the planar surfaces 178 of the slot 158. In certain aspects, the planar surface 148 of the platform 114 may be parallel to and offset from the planar surface 178 of the slot 158. In this manner, the gap 184 may be defined between the planar surface 148 of the platform 114 and the planar surface 178 of the slot 158. Specifically, the gap 184 may be defined between the planar surface 148 of the platform 114 and the planar surface 178 of the slot 158 near the upstream end 132 of the compressor blade 104 and the upstream end 172 of the rotor disk 108. In certain aspects, the gap 184 may extend from the upstream end 132 of the compressor blade 104 and the upstream end 172 of the rotor disk 108 toward the downstream end 134 of the compressor blade 104 to the sealing edge 146.

During operation of the axial compressor 100, the radially outer side 142 of the platform 114 may define the radially inner boundary of the flowpath of the flow of air 20 through the compressor 100. In this manner, the flow of air 20 may pass over the platform 114 from a low-pressure side of the compressor blade 104 to a high-pressure side of the compressor blade 104 as the flow of air 20 is compressed. Meanwhile, the radially inner side 144 of the platform 114 may define the radially outer boundary of the cavity 180 between the platform 114 and the slot 158. In this manner, a flow of leakage air 190 may pass through the cavity 180 from the high-pressure side of the compressor blade 104 to the low-pressure side of the compressor blade 104. However, due to the configuration of the gap 184 between the sealing edge 146 of the platform 114 and the planar surface 178 of the slot 158, the flow of leakage air 190 may be controlled within acceptable limits.

The gap 184 between the sealing edge 146 of the platform 114 and the planar surface 178 of the slot 158 may be minimized by forming the platform 114 and the slot 158 according to methods that allow for particularly tight tolerances of the mating features. For example, the radially inner side 144 of the platform 114 may be machined with a form tool, and the slot 158 of the rotor disk 108 may be broached. By using these methods, the gap 184 may have a nominal value of 0.013 inches with a tolerance of +/−0.011 inches while allowing for tolerance variation of the mating features of the compressor blade 104 and the rotor disk 108.

The axial compressor 100 described herein thus provides an improved configuration for controlling stage-to-stage leakage between the compressor blades 104 and the rotor disk 108. Specifically, due to the small, constant gap 184 between the sealing edge 146 of the platform 114 and the planar surface 178 of the slot 158, the flow of leakage air 190 may be controlled within acceptable limits. In this manner, the compressor 100 eliminates the need for additional components or a sealant at the disk-blade interface, as required by certain known axial compressors including blades having a full-pitch platform configuration. Therefore, the compressor 100 ensures that the limited flow of leakage air 190 and corresponding operability of the compressor 100 remain constant over the lifetime of the compressor 100. Ultimately, the improved configuration increases the efficiency of the compressor 100 and allows the gas turbine engine to achieve greater surge margin with increased efficiency, which directly impacts power output and operational flexibility.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. An axial compressor for a gas turbine engine, the compressor comprising:

a rotor disk positioned along a length of a longitudinal axis of the compressor, wherein the rotor disk comprises a slot defined about a radially outer surface of the rotor disk and extending from an upstream end of the rotor disk to a downstream end of the rotor disk, and wherein the slot comprises a slot planar surface facing radially outward from the rotor disk;

a compressor blade coupled to the rotor disk via the slot, wherein the compressor blade comprises a platform positioned over the radially outer surface of the rotor disk, wherein the platform comprises a platform sealing edge facing toward the rotor disk, wherein the platform sealing edge is parallel to the slot planar surface, and wherein the platform sealing edge and the slot planar surface are angled radially inward; and a gap defined between the platform sealing edge and the slot planar surface, wherein the gap is configured to control a flow of leakage air from a high-pressure side of the compressor blade to a low pressure side of the compressor blade.

2. The axial compressor of claim 1, wherein the platform sealing edge is positioned closer to an upstream end of the platform than a downstream end of the platform, and wherein the slot planar surface is positioned closer to an upstream end of the slot than a downstream end of the slot.

3. The axial compressor of claim 1, wherein the platform further comprises a platform planar surface and a platform curved surface each facing toward the rotor disk, wherein the platform planar surface extends from an upstream end of the platform to the platform sealing edge, and wherein the platform curved surface extends from the platform sealing edge to a downstream end of the platform.

4. The axial compressor of claim 1, wherein the slot comprises a mouth defined about the radially outer surface of the rotor disk and extending from the upstream end of the rotor disk to the downstream end of the rotor disk, and wherein the slot planar surface is positioned on the mouth.

5. The axial compressor of claim 1, wherein the slot extends axially from the upstream end of the rotor disk to the downstream end of the rotor disk.

6. The axial compressor of claim 1, wherein the slot extends obliquely from the upstream end of the rotor disk to the downstream end of the rotor disk.

7. The axial compressor of claim 1, wherein the platform comprises a full-pitch platform comprising lateral surfaces configured to abut lateral surfaces of platforms of adjacent compressor blades.

8. The axial compressor of claim 1, wherein a magnitude of the gap is constant between the platform sealing edge and the slot planar surface.

9. The axial compressor of claim 2, wherein the platform comprises a first lateral surface and a second lateral surface each extending between the upstream end and the downstream end of the platform, wherein the platform sealing edge extends from one of the first lateral surface and the second lateral surface of the platform to a root of the compressor blade, and wherein the slot planar surface extends from the upstream end of the slot toward the downstream end of the slot.

10. A method of controlling stage-to-stage leakage in an axial compressor of a gas turbine engine, the method comprising:

passing a flow of compressed air over a compressor blade from a low-pressure side of the compressor blade to a high-pressure side of the compressor blade;

passing a flow of leakage air between a platform of the compressor blade and a rotor disk from the high-pressure side of the compressor blade to the low-pressure side of the compressor blade; and controlling the flow of leakage air with a gap defined between a platform sealing edge of the platform and a slot planar surface of a slot defined about a radially outer surface of the rotor disk, wherein the slot extends from an upstream end of the rotor disk to a downstream end of the rotor disk, and wherein the gap is positioned closer to the low-pressure side of the compressor blade than the high-pressure side of the compressor blade.

11. The method of claim 10, further comprising minimizing a magnitude of the gap to minimize the flow of leakage air, wherein the magnitude of the gap is constant between the platform sealing edge and the slot planar surface.

12. An axial compressor for a gas turbine engine, the compressor comprising:

a rotor disk positioned along a length of a longitudinal axis of the compressor, wherein the rotor disk comprises a slot defined about a radially outer surface of the rotor disk and extending from an upstream end of the rotor disk to a downstream end of the rotor disk, and wherein the slot comprises a first slot planar surface and a second slot planar surface each facing radially outward from the rotor disk;

a compressor blade coupled to the rotor disk via the slot, wherein the compressor blade comprises a platform positioned over the radially outer surface of the rotor disk, and wherein the platform comprises a first platform sealing edge and a second platform sealing edge each facing toward the rotor disk and positioned closer to an upstream end of the platform than a downstream end of the platform, and wherein the platform comprises a full-pitch platform comprising lateral surfaces configured to abut lateral surfaces of platforms of adjacent compressor blades;

a first gap defined between the first platform sealing edge and the first slot planar surface; and a second gap defined between the second platform sealing edge and the second slot planar surface;

wherein the first gap and the second gap each are configured to control a leakage flow of air from a high-pressure side of the compressor blade to a low pressure side of the compressor blade.

13. The axial compressor of claim 12, wherein the first platform sealing edge is parallel to the first slot planar surface, and wherein the second platform sealing edge is parallel to the second slot planar surface.

14. The axial compressor of claim 12, wherein the first slot planar surface and the second slot planar surface are positioned closer to an upstream end of the slot than a downstream end of the slot.

15. The axial compressor of claim 12 wherein the slot comprises a mouth defined about the radially outer surface of the rotor disk and extending from the upstream end of the rotor disk to the downstream end of the rotor disk, and wherein the first slot planar surface and the second slot planar surface are positioned on the mouth.

16. The axial compressor of claim 12, wherein the compressor blade comprises a root extending radially inward from the platform, and wherein the root is positioned circumferentially between the first platform sealing edge and the second platform sealing edge.

17. The axial compressor of claim 12, wherein the first platform sealing edge is positioned on a concave side of the compressor blade, and wherein the second platform sealing edge is positioned on a convex side of the compressor blade.

* * * * *